US012137810B2

(12) United States Patent
Alletto, Jr. et al.

(10) Patent No.: US 12,137,810 B2
(45) Date of Patent: Nov. 12, 2024

(54) BEDDING SYSTEM, KIT AND METHOD

(71) Applicant: BEDGEAR, LLC, Farmingdale, NY (US)

(72) Inventors: Eugene Alletto, Jr., Glen Head, NY (US); Lorenzo Turicchia, Arlington, MA (US)

(73) Assignee: Bedgear, LLC, Farmingdale, NY (US)

( * ) Notice: Subject to any disclaimer, the term of this patent is extended or adjusted under 35 U.S.C. 154(b) by 0 days.

(21) Appl. No.: 17/155,857

(22) Filed: Jan. 22, 2021

(65) Prior Publication Data

US 2021/0227987 A1 Jul. 29, 2021

Related U.S. Application Data

(60) Provisional application No. 62/967,822, filed on Jan. 30, 2020, provisional application No. 62/965,334, filed on Jan. 24, 2020.

(51) Int. Cl.
*A47C 21/00* (2006.01)
*A47C 20/04* (2006.01)
(Continued)

(52) U.S. Cl.
CPC ..... *A47C 20/048* (2013.01); *A47C 27/007* (2013.01); *A47C 27/06* (2013.01)

(58) Field of Classification Search
CPC ..... A47C 21/00; A47C 27/04; A47C 27/042; A47C 27/044; A47C 27/007; A47C 20/048; A47C 27/06
See application file for complete search history.

(56) References Cited

U.S. PATENT DOCUMENTS 1,142,876 A * 6/1915 Davis ..... A47C 21/048 5/284
6,546,576 B1 * 4/2003 Lin ..... A47C 21/048 5/652.2
(Continued)

FOREIGN PATENT DOCUMENTS

WO 2015157766 A1 10/2015
WO 2018022760 A1 2/2018
WO 2019165074 A1 8/2019

OTHER PUBLICATIONS

Patent Cooperation Treaty—PCT—International Preliminary Report on Patentability, Written Opinion of the International Searching Authority, International application No. PCT/US2021/014635, Date of issuance of this report Jul. 26, 2022 (Jul. 26, 2022).
(Continued)

*Primary Examiner* — Fredrick C Conley
(74) *Attorney, Agent, or Firm* — Sorell, Lenna & Schmidt, LLP

(57) ABSTRACT

A bedding system includes an adjustable base comprising a tambour. An air control unit is coupled to the base. The air control unit includes a left fan and a right fan. The fans are positioned under the tambour. A first air passage is connected to the left fan. A second air passage is connected to the right fan. A sealed bag is positioned on the base. The bag includes a spacer and coils positioned therein. The bag includes opposite top and bottom ends. The top and bottom ends are each being breathable. A duct that connects the bottom end to the first and second air passages. A breathable comfort layer is positioned on the bag. A mattress cover is positioned on the comfort layer. Kits and method of use are disclosed.

17 Claims, 14 Drawing Sheets

(51) Int. Cl.
*A47C 27/00* (2006.01)
*A47C 27/06* (2006.01)

(56) References Cited

U.S. PATENT DOCUMENTS

| | | | | |
|---|---|---|---|---|
| 6,709,065 | B2 * | 3/2004 | Peay | B28D 1/188 299/111 |
| 2007/0136952 | A1 * | 6/2007 | Sargent | A47C 21/044 5/423 |
| 2011/0115635 | A1 * | 5/2011 | Petrovski | A47C 31/008 340/584 |
| 2014/0201919 | A1 * | 7/2014 | Albero | A61G 7/05769 5/652.2 |
| 2015/0289667 | A1 * | 10/2015 | Oakhill | A47C 27/18 5/423 |
| 2016/0353907 | A1 * | 12/2016 | Lava | A47C 27/002 |
| 2017/0348182 | A1 * | 12/2017 | Yoo | A47C 31/008 |
| 2018/0242753 | A1 * | 8/2018 | Ghanei | A47C 21/044 |
| 2019/0223614 | A1 | 7/2019 | Aramli | |

OTHER PUBLICATIONS

Canada Office Action: Canadian Appl No. 3165692: 4 pgs: Jan. 3, 2024.

* cited by examiner

BEDDING SYSTEM, KIT AND METHOD

TECHNICAL FIELD

The present disclosure generally relates to bedding, and more particularly to adjustable bedding systems that are modular and configured to be personalized based on comfort choices and that include individual components that can be upgraded and/or replaced.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable in order to achieve restful sleep.

Two popular mattress choices currently available are spring mattresses and foam mattresses. However, because foam mattresses consist of a foam, such as, for example, memory foam, such foam mattresses are typically not sturdy enough to provide proper support to a sleeper's body. Foam mattresses also lack the ability to clean within the foam mattress or replace components of the foam mattress over time. For example, if the sleeper's desired comfort choice changes over time, he or she will be required to purchase a completely new foam mattress to accommodate the user's new comfort choice. Spring mattresses are typically pre-assembled and are shipped to a destination as freight due to the size of the spring mattress. That is, most spring mattresses cannot be shipped by ground delivery because the spring mattresses each exceed the size permitted for ground delivery. Moreover, because spring mattresses are typically pre-assembled, spring mattresses lack the ability to clean within the spring mattress or replace components of the spring mattress over time. For example, if the springs of the spring mattress wear out, the sleeper will be required to purchase a completely new spring mattress.

Furthermore, conventional mattresses lack any means to draw ambient air away from a sleeping surface of the mattress and/or to direct air flow to the sleep surface. Conventional mattresses also lack a temperature the ability to be selectively tilted based on the preference of the sleeper. This disclosure describes an improvement over these prior art technologies.

SUMMARY

In one embodiment, in accordance with the principles of the present disclosure, a bedding system is provided that includes a base and an air control unit coupled to the base. A bag is positioned on the base. The bag comprises a spacer and coils positioned therein. A comfort layer is positioned on the bag. A mattress cover is positioned on the comfort layer.

In one embodiment, in accordance with the principles of the present disclosure, the control unit comprises a left fan and a right fan.

In one embodiment, in accordance with the principles of the present disclosure, the base comprises a tambour and the air control unit comprises a left fan and a right fan, the fans being positioned under the tambour.

In one embodiment, in accordance with the principles of the present disclosure, the base is adjustable and the bedding system comprises a first air passage and a second air passage. The first air passage is connected to the left fan. The second air passage is connected to the right fan.

In one embodiment, in accordance with the principles of the present disclosure, the bag comprises opposite top and bottom ends. The top and bottom ends are being breathable. The bedding system comprising a duct that connects the bottom end to the first and second air passages.

In one embodiment, in accordance with the principles of the present disclosure, the bag is sealed.

In one embodiment, in accordance with the principles of the present disclosure, the comfort layer is breathable.

In one embodiment, in accordance with the principles of the present disclosure, the bedding system comprises a chassis wherein the bag is positioned within a cavity of the chassis. The bedding system includes a clamp coupled to the base such that the clamp is rotatable relative to the base. The clamp is configured to fix the chassis to the base. In one embodiment, the base includes a first clamp at a head end of the base and a second clamp at an opposite foot end of the base.

In one embodiment, in accordance with the principles of the present disclosure, the bag is coupled to the base by a fastener, such as, for example, a zipper. In some embodiments, the fastener is positioned between the spacer and the base.

In one embodiment, in accordance with the principles of the present disclosure, the base comprises a first end wall and an opposite second end wall and the spacer is positioned between the end walls to bookend the spacer atop the base.

In one embodiment, in accordance with the principles of the present disclosure, the fans mount directly into adjustable base, closer to feet than head, feet retainer only. There is no ductwork/tubing required and there is little sliding of the bag relative to the base (no/little movement at feet; little movement at middle; most movement at head).

In one embodiment, in accordance with the principles of the present disclosure, a bedding system is provided that includes an adjustable base comprising a tambour. An air control unit coupled to the base. The air control unit comprises a left fan and a right fan. The fans are positioned under the tambour. A first air passage connected to the left fan. A second air passage is connected to the right fan. A sealed bag is positioned on the base. The bag comprises a spacer and coils positioned therein. The bag comprises opposite top and bottom ends. The top and bottom ends are each being breathable. A duct connects the bottom end to the first and second air passages. A breathable comfort layer is positioned on the bag. A mattress cover is positioned on the comfort layer.

In one embodiment, in accordance with the principles of the present disclosure, a bedding system is provided that includes a base comprising a frame. A mattress is positioned on top of the base. The mattress comprises a chassis comprising a bottom wall, opposite first and second side walls extending upwardly from the bottom wall and opposite first and second end walls extending upwardly from the bottom wall. The walls define a cavity. The bottom wall defines an opening that is in communication with the cavity. A coil pack is positioned in the cavity. The coil pack comprises a plurality of springs. A comfort layer is positioned over the coil pack. The comfort layer is attached to the chassis by a first zipper. A cover is positioned over the comfort layer. The cover is attached to the chassis by a second zipper. An air control assembly comprises a power unit and a duct having a first end that is connected to the power unit and a second end that is positioned in the opening.

In one embodiment, in accordance with the principles of the present disclosure, the power unit is configured to create negative pressure that moves air adjacent to the cover through the cover and the comfort layer and into the cavity.

In one embodiment, in accordance with the principles of the present disclosure, the power unit is configured to create negative pressure that moves air within the cavity into the power unit.

In one embodiment, in accordance with the principles of the present disclosure, the power unit is configured to create positive pressure that moves air in the cavity through the comfort layer and the cover.

In one embodiment, in accordance with the principles of the present disclosure, the base comprises a tilting assembly coupled to the frame, the tilting assembly comprising opposite first and second ends and a hinge between the first end and the second end configured to allow the first end to pivot relative to the second end. In some embodiments, the mattress comprises a head end and an opposite foot end, the mattress being positioned on top of the tilting assembly such that the foot end pivots relative to the head end as the first end of the tilting assembly pivots relative to the second end of the tilting assembly.

In one embodiment, in accordance with the principles of the present disclosure, the bedding system includes a top suction connector extending into a top end of the coil pack. The top suction connector is in communication with the opening.

In one embodiment, in accordance with the principles of the present disclosure, the bedding system includes a mid-suction connector extending into a bottom end of the coil pack. The mid-suction connector is in communication with the opening.

In one embodiment, in accordance with the principles of the present disclosure, the power unit is coupled directly to the frame.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
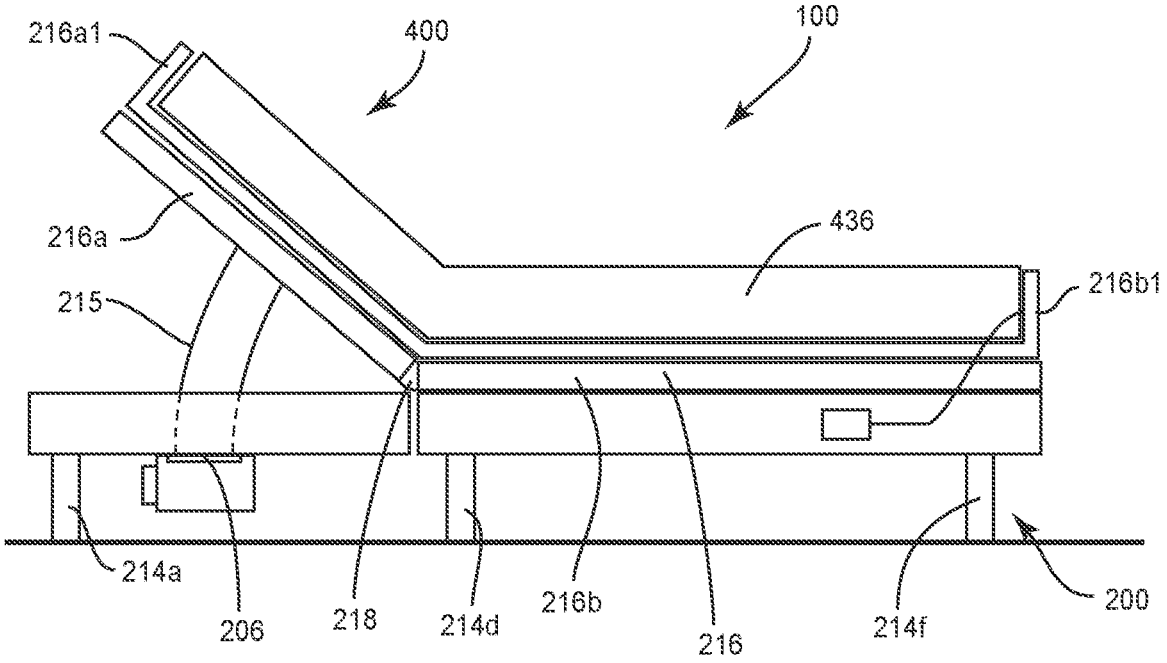
FIG. 1 is a side view of one embodiment of a bedding system, in accordance with the principles of the present disclosure.
Figure 2:
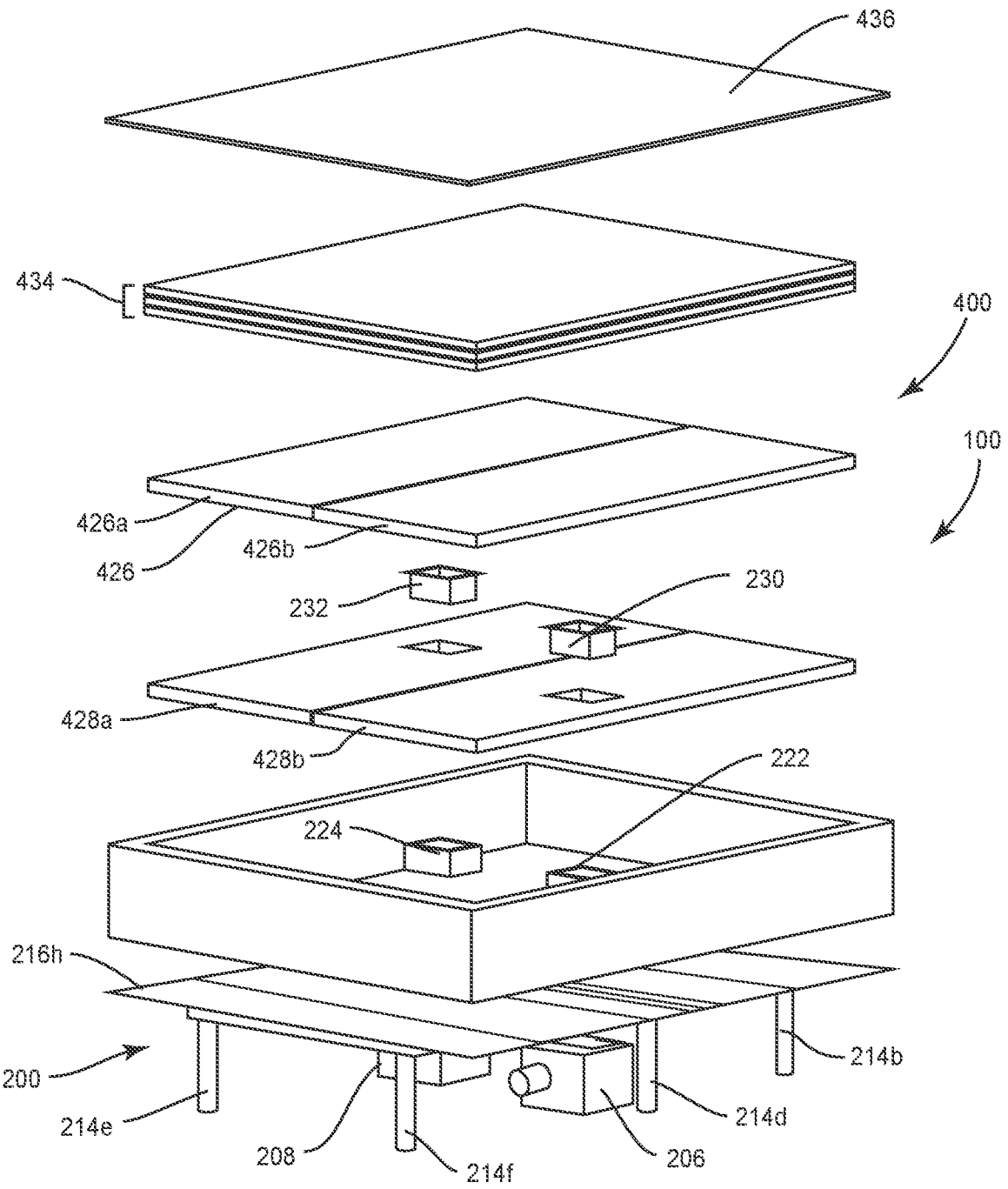
FIG. 2 is a perspective view of components of a bedding system, in accordance with the principles of the present disclosure, with parts separated.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

The bedding system disclosed herein includes a bed/bedding system that is the same or similar to the bed/bedding system disclosed in U.S. Patent Application No. 62,796,330, filed Jan. 24, 2019 and/or U.S. Patent Application No. 62,796,867, filed on Jan. 25, 2019, and/or includes components that are the same or similar to components disclosed in U.S. Patent Application Nos. 62,796,330 and 62,796,867. U.S. Patent Application Nos. 62,796,330 and 62,796,867 are both expressly incorporated herein by reference, in their entireties. In particular, the bedding system disclosed herein includes an aerated bed in combination with a powerbase. In some embodiments, one or more fans, such as, for example, left and right fans are included in the powerbase under a tambour of the aerated bed. In some embodiments, the powerbase is an adjustable base with left and right air passages at mid-length that are connected to the fans. In some embodiments, additional air passage is possible at tilting upper length. In some embodiments, the aerated bed includes a spacer and overlying coils in one sealed bag. In some embodiments, the bag is super-breathable at top and bottom with the bottom of the bag being connected to the air passages via ductwork/tubing. In some embodiments, the aerated bed includes a perforated comfort layer atop the bag. In some embodiments, the aerated bed includes a breathable mattress cover atop the comfort layer. In some embodiments, the spacer (bagged still) is positioned outside of the aerated bed atop the powerbase with the spacer as separate or integrated component.

In some embodiments, the spacer is firmly connected to the powerbase via (a) toe and/or head cleats on the powerbase that grab the aerated bed; (b) a fastener (e.g., a zipper) between the spacer and the powerbase; and/or (c) a headboard element to bookend the aerated bed atop the powerbase. In some embodiments, the bedding system does not use metal retainers in the powerbase to avoid problems with the spacer during operation of the powerbase in compression (mattress will break retainer at feet; mattress will tend not to compress with retainer at head). In some embodiments, the fans are mounted directly into powerbase, closer to feet than head, such that no ductwork/tubing is required and sliding or other movement at the feet, at middle and at the head is reduced, with the most amount of movement at the head.

The bedding system disclosed herein includes a mattress assembly that is configured to lie on top of a foundation, such as, for example, a base. In some embodiments, the base is an adjustable base. In some embodiments, the mattress assembly of the bedding system is a modular performance mattress that features dual-sided independent suspension and air flow certification in every component of the mattress assembly. In some embodiments, the modular design of the mattress assembly allows a sleeper to personalize his or her comfort. For example, in some embodiments, the mattress assembly can include a plurality of comfort choices for the sleeper and his or her sleep partner. In some embodiments, the mattress assembly is compatible for use with a proven system and consistent fitting history that personalizes components of a bedding system, from a pillow to a mattress assembly.

In some embodiments, the mattress assembly of the bedding system is sustainable as it allows individual components to be upgraded over the lifetime of the mattress assembly. For example, coil packs of the mattress assembly can be replaced if the sleeper's comfort preferences change. It is envisioned that allowing individual components to be upgraded and/or replaced avoids replacing an entire mattress assembly each time a component wears out or needs to be upgraded, thus significantly reducing landfill waste and our carbon footprint.

In some embodiments, the mattress assembly of the bedding system is configured for clean sleep as independent suspension components of the mattress assembly can be removed to allow the inside of a chassis of the mattress assembly to be vacuumed out during periodic deep cleanings. In some embodiments, the mattress assembly includes a top cover and comfort layer that are both removable and washable in cold water on the gentle cycle of a washing machine. In some embodiments, the mattress assembly includes a ventilated construction that prevents warm air and moisture from getting trapped in the mattress, which can lead to the growth of mold and mildew.

In some embodiments, the top cover of the mattress assembly of the bedding system is made from materials selected to provide certain desired characteristics, such as, for example, ventilation. In some embodiments, the top cover can include materials, such as, for example, VER-TEX®, manufactured by Bedgear, LLC of Farmingdale, New York, to provide a cover having a cool touch that is also removable, washable and zips off for easy care. In some embodiments, the VER-TEX® provides instant heat deflection. In some embodiments, the top cover can include materials, such as, for example, AIR-X®, manufactured by Bedgear, LLC of Farmingdale, New York, to provide ventilation inside and out and enhanced air flow that removes humidity and excess body heat. In some embodiments, the top cover includes a quilted design to enhance the feel of the comfort layer.

In some embodiments, the comfort layer of the mattress assembly of the bedding system is made from materials selected to provide certain desired characteristics, such as, for example, support. In some embodiments, the comfort layer can include materials, such as, for example, REACT®, manufactured by Bedgear, LLC of Farmingdale, New York, to provide weightless support that contours to the sleeper and creates cooler comfort. In some embodiments, the comfort layer can include materials, such as, for example, MICRO-CURL®, manufactured by Bedgear, LLC of Farmingdale, New York, to reduce motion transfer. In some embodiments, the comfort layer can include materials, such as, for example, BOOST®, manufactured by Bedgear, LLC of Farmingdale, New York, to provide dynamic support that adapts to the sleeper.

In some embodiments, the independent suspension of the mattress assembly of the bedding system includes individually wrapped coils to provide personalized support. In some embodiments, the coils are 8 inch coils. In some embodiments, the coils are greater than 8 inches. In some embodiments, the coils are less than 8 inches. In some embodiments, the chassis of the mattress assembly of the bedding system is sturdy to provide supportive structure. In some embodiments, the chassis is wrapped in AIR-X®, manufactured by Bedgear, LLC of Farmingdale, New York, to ensure maximum airflow.

As used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a bedding system in accordance with the principles of the present disclosure. Alternate embodiments are also disclosed. Reference will now be made in detail to the exemplary embodiments of the present disclosure, which are illustrated in the accompanying figures. Turning to FIGS. 1-16, there are illustrated components of a bedding system 100.

System 100 includes a base 200 and a mattress assembly 400 that is configured to sit on top of base 200 to position a sleep surface 436 of mattress assembly 400 a selected height above a floor of a room, as discussed herein. In some embodiments, base 200 includes a frame 202 and tilting assembly 204 coupled to frame 202. In some embodiments, one or more power units, such as, for example, one or more fans 206, 208 are coupled to frame 202. In some embodiments, fan 206 and/or fan 208 are configured to create negative pressure that moves air adjacent to sleep surface 436 into a cavity of mattress assembly 400, as discussed herein. In some embodiments, fan 206 and/or fan 208 are configured to create negative pressure that moves air within a cavity of mattress assembly 400 into a housing of fan 206 and/or a housing of fan 208, as discussed herein. In some embodiments, fan 206 and/or fan 208 are configured to create positive pressure that moves air within a cavity of mattress assembly 400 out of mattress assembly 400, as discussed herein. In some embodiments, base 200 includes one or a plurality of fans that are the same or similar to fans 206, 208. That is, base 200 can include only one fan (e.g., fan 206 or fan 208) or any number of fans (e.g., fan 206, fan 208 and additional fans).

Platform 216 includes a plurality of sections that are configured to be rotated and/or pivoted relative to one another via tilting assembly 204 to selectively incline mattress assembly 400, as discussed herein. For example, in one embodiment, shown in FIG. 1, platform 216 includes a section 216*a* that is connected to a section 216*b* by a hinge 218. Section 216*b* is rotatable relative to section 216*a* about hinge 218 to move platform 216 between a first orientation in which section 216*a* extends parallel to section 216*b* and a second orientation in which section 216*a* extends at an angle between about 1 degree to about 90 degrees relative to section 216*b*. In some embodiments, section 216*a* includes a vertical wall 216*a*1 and section 216*b* includes a vertical wall 216*b*1. Mattress assembly 400 is configured to be positioned between walls 216*a*1, 216*b*1 to prevent mattress assembly 400 from sliding relative to base 200, as discussed herein. In some embodiments, fan 206 is connected to platform 216 by a duct 215, as shown in FIG. 1.

Figure 3:
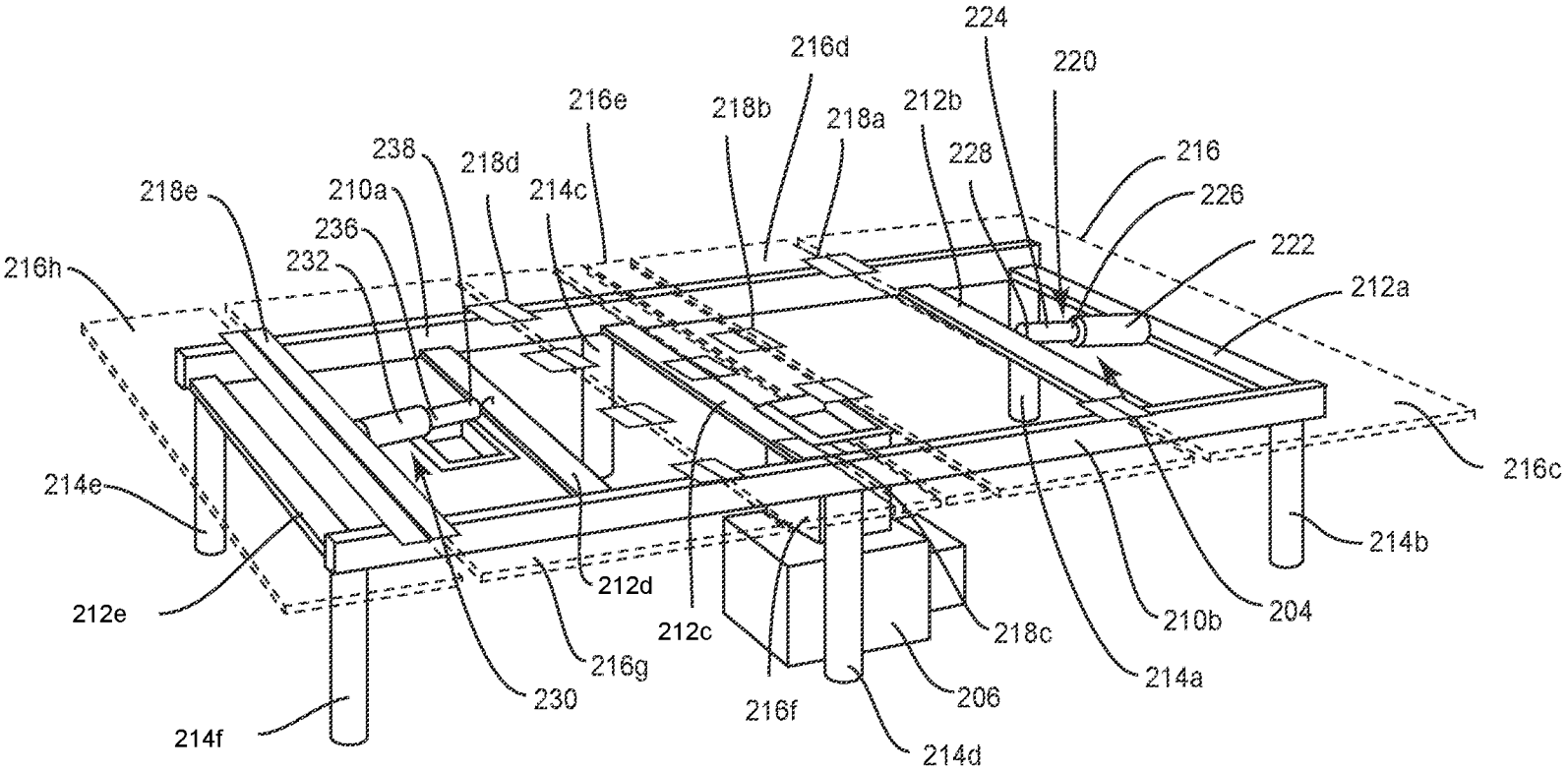
FIG. 3 is a perspective view of components of the bedding system shown in FIG. 2.
Figure 4:
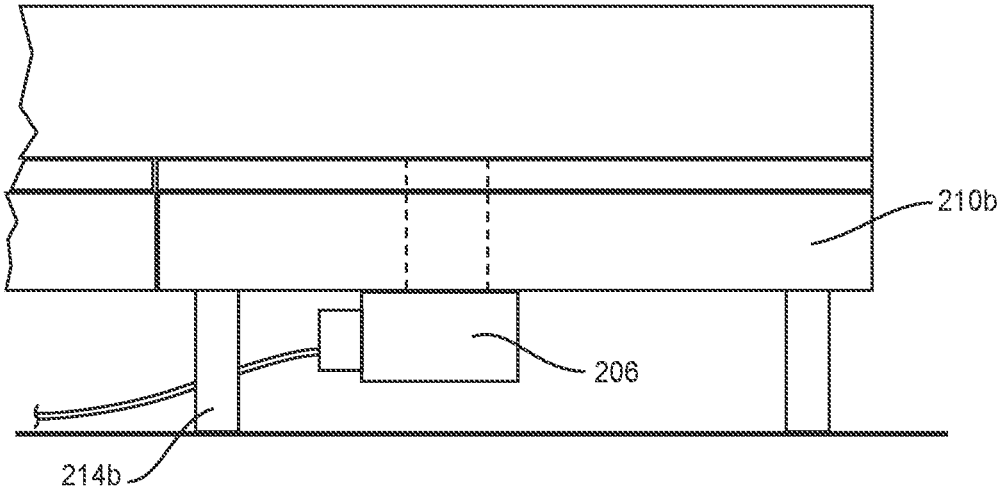
FIG. 4 is a side view of components of the bedding system shown in FIG. 2.
Figure 5:
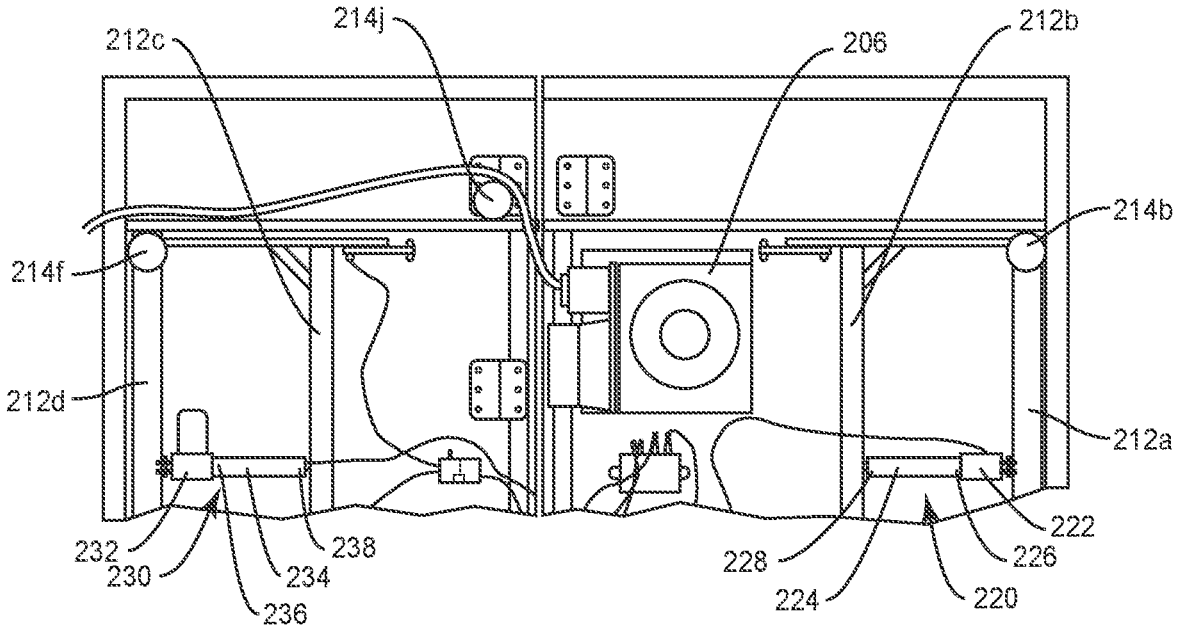
FIG. 5 is a bottom view of components of the bedding system shown in FIG. 2.
Figure 6:
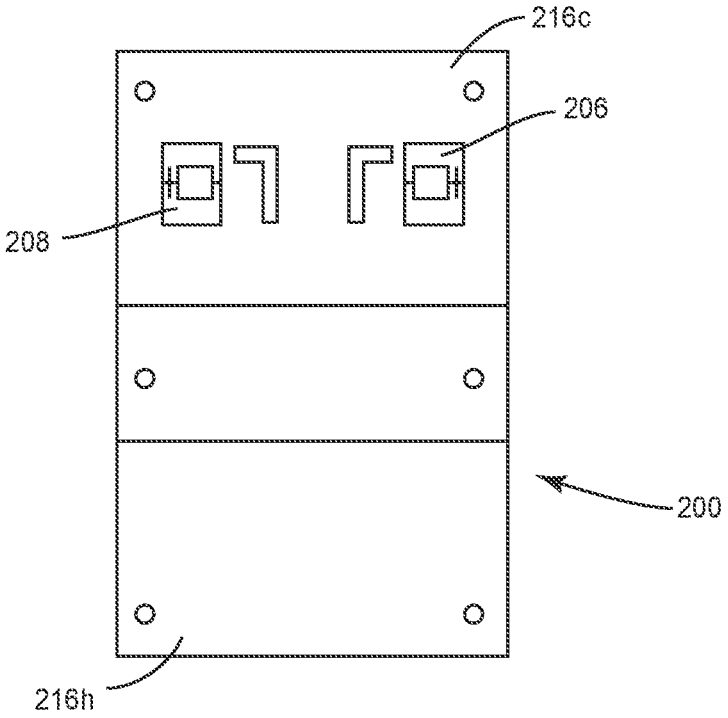
FIG. 6 is a top view of a component of the bedding system shown in FIG. 2.

In one embodiment, shown in FIGS. 2-6, frame 202 includes longitudinal rails 210*a*, 210*b* and transverse rails 212*a*, 212*b*, 212*c*, 212*d*, 212*e* and 212*f* that each join rail 210*a* with rail 210*b*, as best shown in FIG. 3. Rails 210*a*, 210*b* each extend parallel to one another. Rails 212*a*, 212*b*, 212*c*, 212*d*, 212*e* and 212*f* each extends perpendicular to rails 210*a*, 210*b*. Vertical legs 214*a*, 214*b* are supported by rails 210*a*, 210*b*, 212*a*; vertical legs 214*c*, 214*d* are supported by rails 210*a*, 210*b*, 212*c*; and vertical legs 214*e*, 214*f* are supported by rails 210*a*, 210*b* and 212*e*. Rails 210*a*, 210*b*, 212*a*, 212*b*, 212*c*, 212*d*, 212*e* and 212*f* support a tambour, such as, for example, a platform 216 and fan 206 and/or fan 208 are positioned under platform 216.

Platform 216 includes sections 216*c*, 216*d*, 216*e*, 216*f*, 216*g*, 216*h*. Section 216*d* is connected to section 216*c* by one or more hinges 218*a* and is rotatable relative to section 216*c* about hinges 218*a*; section 216*d* is connected to section 216*e* by one or more hinges 218*b* and is rotatable relative to section 216*e* about hinges 218*b*; section 216*f* is connected to section 216*e* by one or more hinges 218*c* and is rotatable relative to section 216*e* about hinges 218*c*; section 216*g* is connected to section 216*f* by one or more hinges 218*d* and is rotatable relative to section 216*f* about hinges 218*d*; and section 216*h* is connected to section 216*g* by one or more hinges 218*e* and is rotatable relative to section 216*g* about hinges 218*e*.

Tilting assembly 204 includes a hydraulic cylinder 220 that includes a tube 222 that is coupled to rail 212*a* and a rod 224 having an end 226 movably positioned in tube 222 and an opposite end 228 that is coupled directly to rail 212*b*. Rod 224 is movable relative to tube 222 to move rail 212*b* toward and away from rail 212*a*. As rail 212*b* moves toward rail 212*a*, section 216*d* rotates relative to section 216*c* about hinges 218*a* in a first rotational direction. As rail 212*b* moves away from rail 212*a*, section 216*d* rotates relative to section 216*c* about hinges 218*a* in an opposite second rotational direction. In some embodiments, tube 222 is coupled to section 216*d* and end 228 is coupled directly to rail 212*a*.

Tilting assembly 204 further includes a hydraulic cylinder 230 that includes a tube 232 that is coupled to rail 212*d* and a rod 234 having an end 236 movably positioned in tube 232 and an opposite end 238 that is coupled directly to rail 212*c*. Rod 234 is movable relative to tube 232 to move rail 212*c* toward and away from rail 212*d*. As rail 212*c* moves toward rail 212*d*, section 216*h* rotates relative to section 216*g* about hinges 218*e* in a first rotational direction. As rail 212*c* moves away from rail 212*d*, section 216*h* rotates relative to section 216*g* about hinges 218*e* in an opposite second rotational direction. In some embodiments, tube 232 is coupled to section 216*g* and end 238 is coupled directly to rail 212*d*.

In some embodiments, mattress assembly 400 is removably coupled to base 200 such that mattress assembly 400 can be removed from base 200 to clean mattress assembly 400, for example. In some embodiments, mattress assembly 400 is permanently fixed to base 200 to prevent unintended movement of mattress assembly 400 relative to base 200. In some embodiments, mattress assembly 400 can be variously connected with base 200, such as, for example, monolithic, integral connection, frictional engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

It is envisioned that fan 206, fan 208 and/or any additional fans of base 200 can be selectively positioned along frame 202. For example, in one embodiment, shown in FIGS. 3-5, fans 206, 208 are positioned at a midsection of frame 202 such that fans 206, 208 are each positioned substantially equidistant from rails 212*a*, 212*d*. In another embodiment, shown in FIG. 6, fans 206, 208 are positioned at one end of frame 202 such that fans 206, 208 are each positioned directly below section 216*c*. That is, in the embodiment shown in FIG. 6, fans 206, 208 are each positioned at a head end of frame 202. However, it is envisioned that fans 206, 208 may be each positioned at an opposite end of frame 202.

Figure 7:
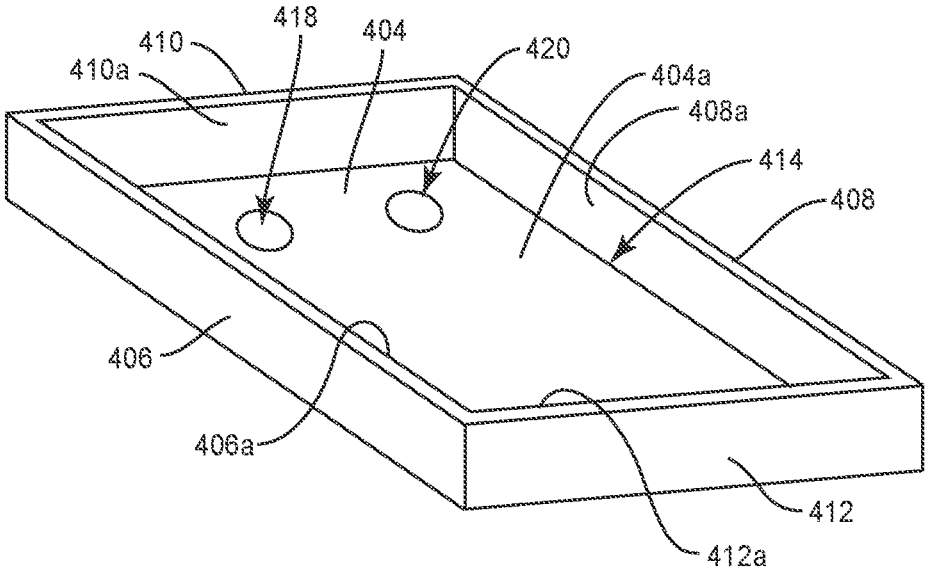
FIG. 7 is a perspective view of a component of the bedding system shown in FIG. 2.
Figure 8:
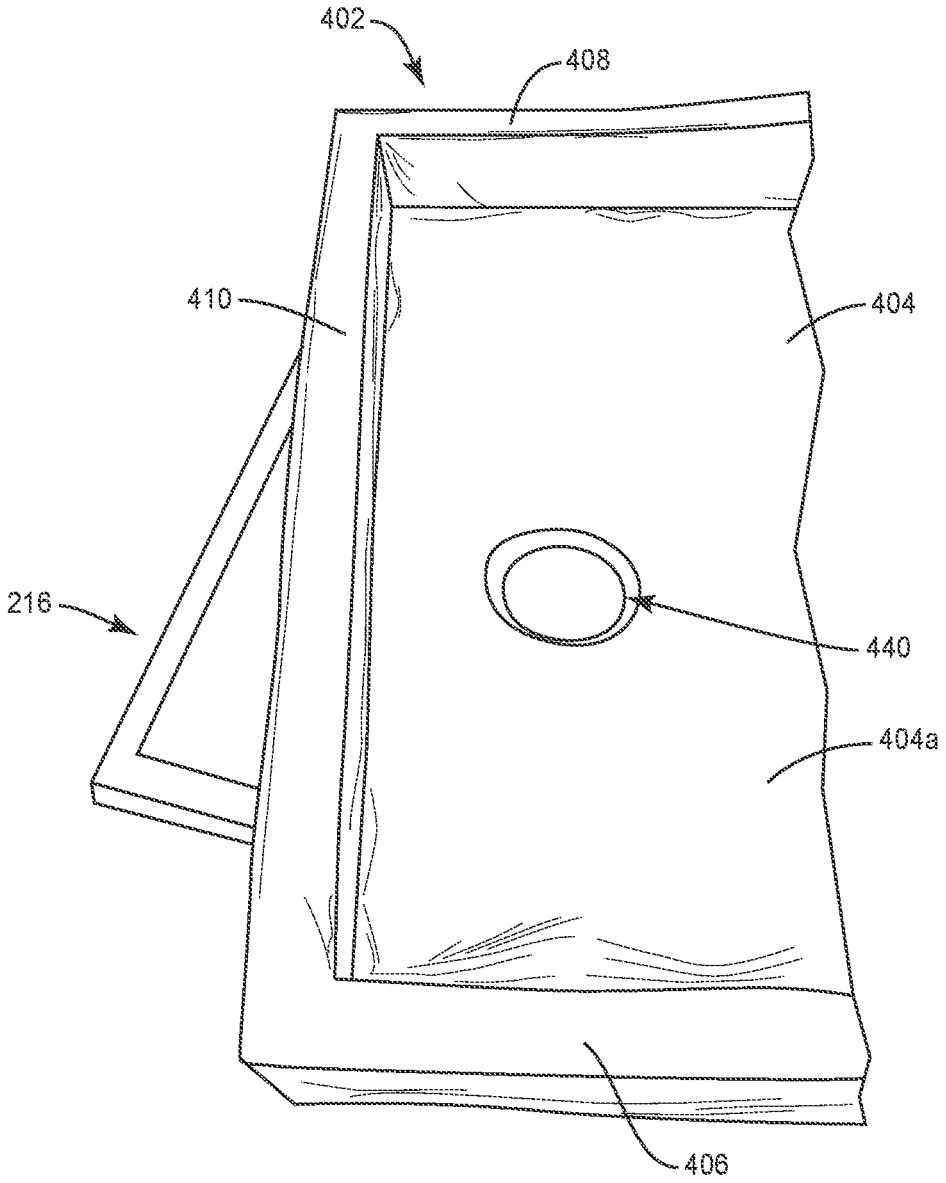
FIG. 8 is a perspective view of components of the bedding system shown in FIG. 2.

Mattress assembly 400 includes a chassis 402 comprising a bottom wall 404, a side wall 406, a side wall 408 opposite wall 406, an end wall 410 and an end wall 412 opposite wall 410, as shown in FIG. 7, for example. Wall 406 extends parallel to wall 408 and wall 410 extends parallel to wall 412. In some embodiments, walls 406, 408 each extend perpendicular to walls 410, 412. Walls 406, 408, 410, 412 each extend upwardly from wall 404. In some embodiments, walls 404, 406, 408, 410, 412 define a body of chassis 402. A top surface 404*a* of wall 404, an inner surface 406*a* of wall 406, an inner surface 408*a* of wall 408, an inner surface 410*a* of wall 410 and an inner surface 412*a* of wall 412 define a cavity 414. In some embodiments, chassis 402 comprises a foam casing. In some embodiments, wall 404 is permeable to allow air to move in opposite directions through a thickness of wall 404. In some embodiments, wall 404 is impermeable to prevent air from moving through the thickness of wall 404.

In one embodiment, shown in FIG. 7, chassis 402 includes spaced apart openings 418, 420 that each extend through surface 404*a* and an opposite bottom surface of wall 404 and is configured for use with embodiments of base 200 in which base 200 includes more than one fan (e.g., fan 206 and fan 208). Opening 418 is configured to be in communication with fan 206 and opening 420 is configured to be in communication with fan 208.

In some embodiments, mattress assembly 400 includes a first air passage, such as, for example, a connector 422 positioned in opening 418 such that connector 422 is coupled to fan 206 and a second air passage, such as, for example, a connector 424 positioned in opening 420 such that connector 424 is coupled to fan 208. One or more spring packs, such as, for example, coil pack 426 is positioned within cavity 414 over connectors 422, 424. In some embodiments, coil pack 426 includes a first part 426*a* and a second part 426*b* that is unconnected to part 426*a*. Part 426*a* is configured to support the body of a first sleeper and part 426*b* is configured to support the body of a second sleeper. It is envisioned that parts 426*a*, 426*b* may have different characteristics, such as, for example, firmness to accommodate the preferences of different sleepers. In some embodiments, part 426*a* is positioned within a cover 428*a* and part

426*b* is positioned within a cover 428*b*. A connector 430 is coupled to cover 428*b* such that connector 430 is in communication with connector 422. A connector 432 is coupled to cover 428*a* such that connector 432 is in communication with connector 424. A comfort layer 434 is positioned over covers 428*a*, 428*b* and a cover 438 is positioned over comfort layer 434. In some embodiments, cover 438 is coupled to chassis 402 by a fastener, such as, for example, a zipper. In some embodiments, a top surface of cover 438 defines surface 436. In some embodiments, cover 438 is made from a breathable material to allow air to move in opposite directions through a thickness of cover 438. In some embodiments, comfort layer 434 is perforated to allow air to move in opposite directions through a thickness of comfort layer 434. In some embodiments, connectors 422, 424 each include a flange that directly engages surface 404*a* when connectors 422, 424 are positioned in openings 418, 420 to prevent connectors 422, 424 from falling through openings 418, 420.

In one embodiment, fans 206, 208 are each movably from an off position to an on position in which fans 206, 208 create negative pressure to draw air above surface 436 through cover 438, comfort layer 434, connectors 430, 432, 422, 424 and into fans 206, 208 to alter the temperature of surface 436 and/or air directly above surface 436. For example, drawing warm air away from surface 436 can cause the warm air to be replaced with cooler air to thereby cool surface 436 and/or air directly above surface 436. In another embodiment, fans 206, 208 are each movably from an off position to an on position in which fans 206, 208 create positive pressure to move air from fans 206, 208 through connectors 430, 432, 422, 424, comfort layer 434 and cover 438 to alter the temperature of surface 436 and/or air directly above surface 436. For example, moving cool air from fans 206, 208 through surface 436 can reduce the temperature of surface 436 and/or air directly above surface 436 to thereby cool surface 436 and/or air directly above surface 436.

Figure 9:
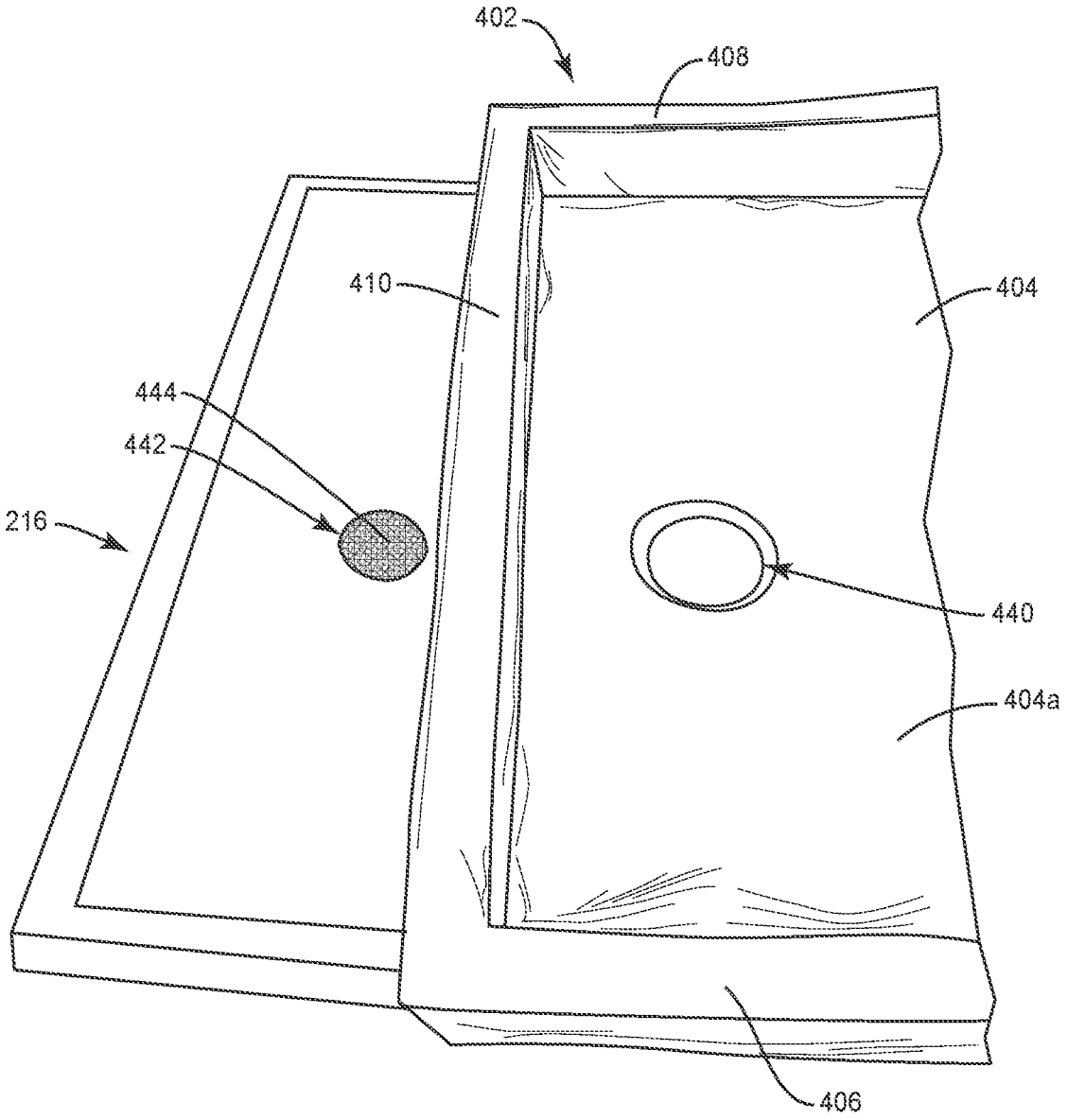
FIG. 9 is a perspective view of components of the bedding system shown in FIG. 2.
Figure 10:
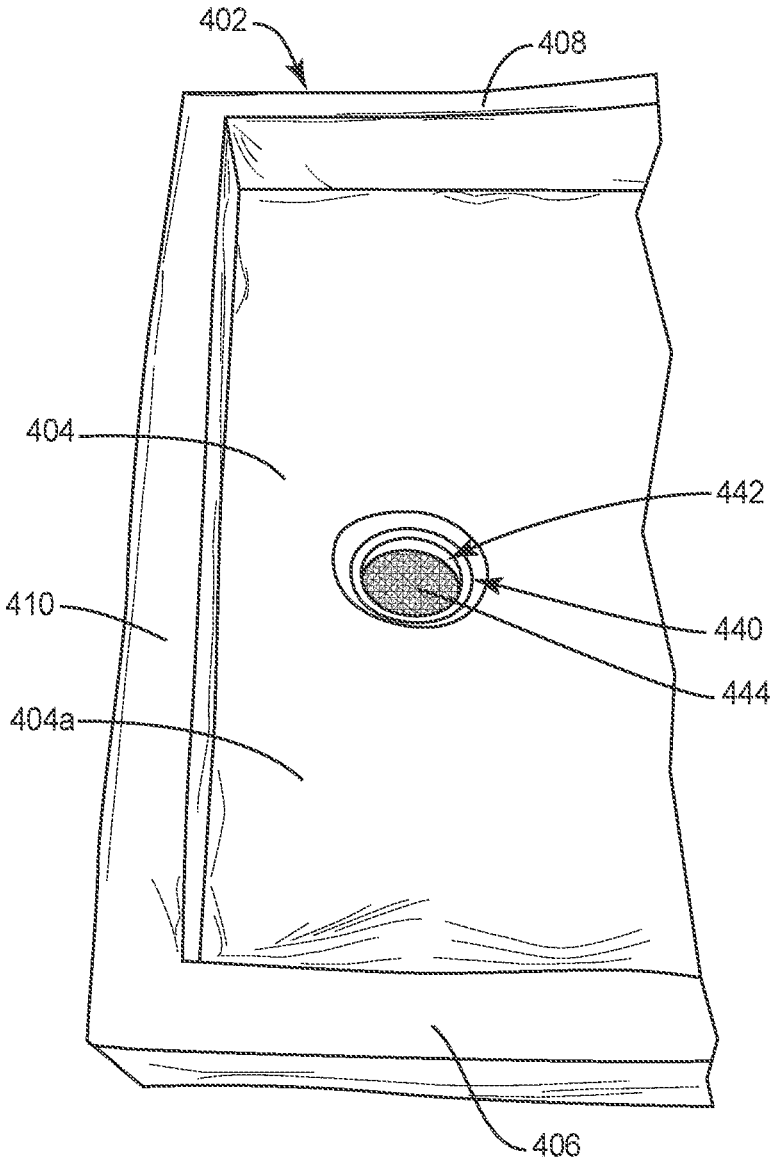
FIG. 10 is a perspective view of components of the bedding system shown in FIG. 2.

In one embodiment, shown in FIGS. 8-16, chassis 402 includes only a single opening 440 that extends through surface 404*a* and the opposite bottom surface of wall 404. Opening 440 is configured for use with embodiments of base 200 in which base 200 includes only one fan (e.g., fan 206 or fan 208). Opening 440 is configured to be in communication with fan 206. Platform 216 includes a hole 442 that in communication with a fan, such as, for example, fan 206 or fan 208. In some embodiments, chassis 402 is positioned relative to platform 216 such that opening 440 is aligned with hole 442 such that opening 440 is coaxial with hole 442, as best shown in FIG. 10.

Figure 11:
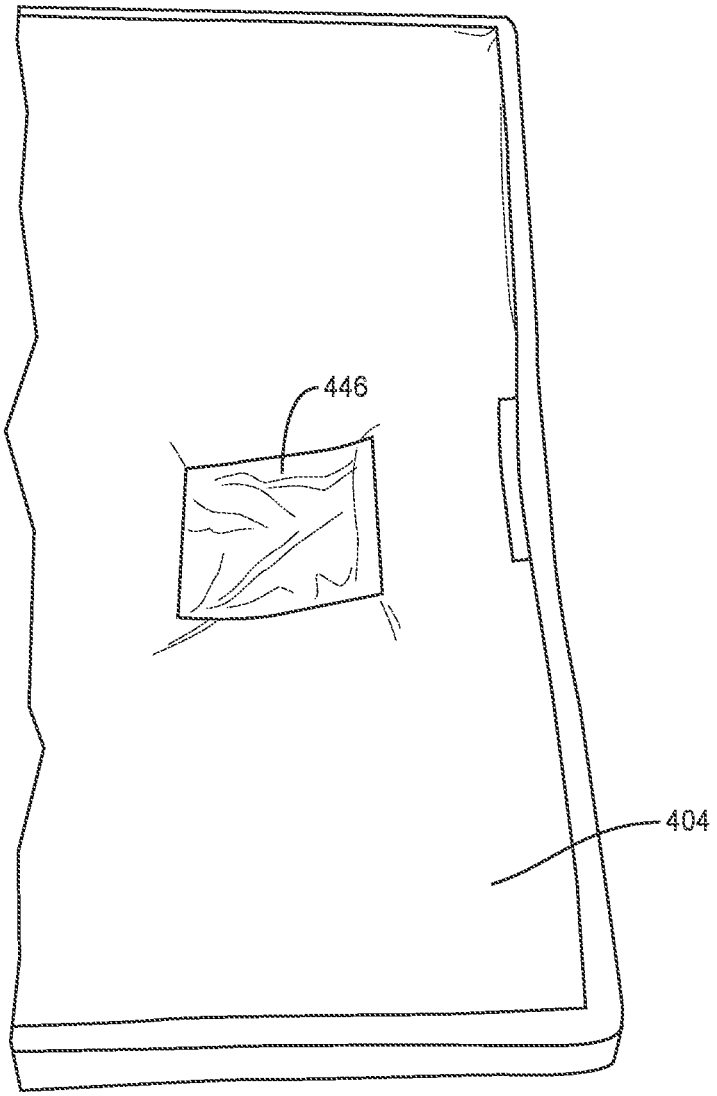
FIG. 11 is a perspective view of components of the bedding system shown in FIG. 2.
Figure 12:
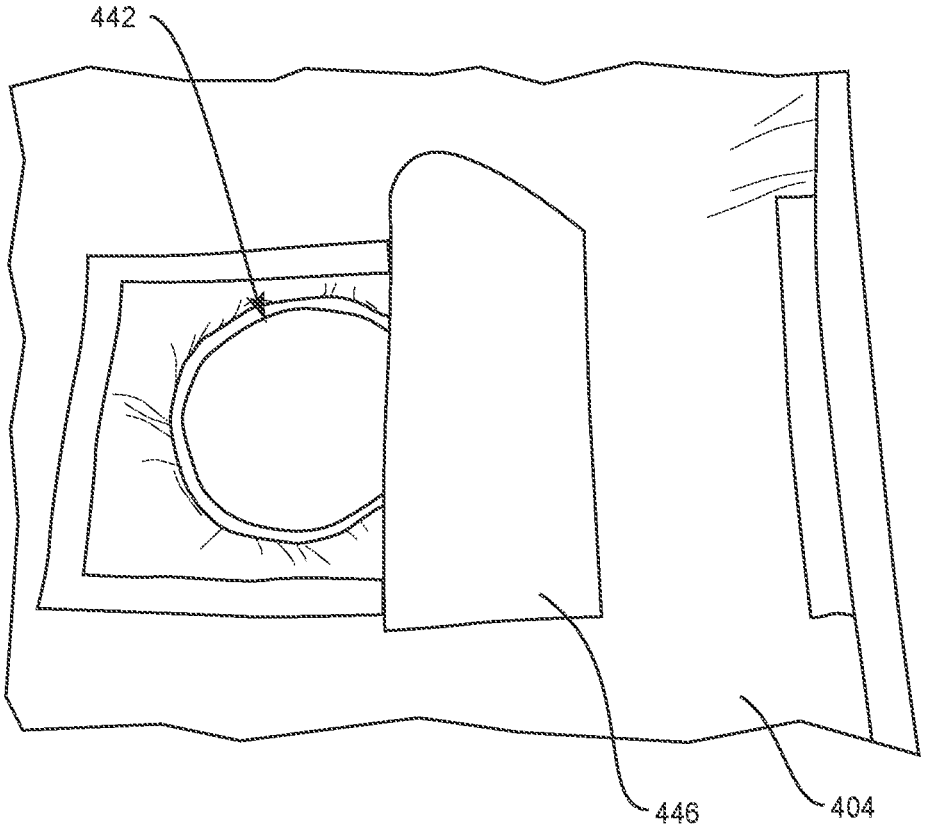
FIG. 12 is a perspective view of components of the bedding system shown in FIG. 2.

In some embodiments, hole 442 is covered with a mesh material or filter material 444 configured to trap debris that moves through hole 442. That is, material 444 is configured to catch debris that moves through hole 442, while allowing air to flow through hole 442. In some embodiments, chassis 402 includes a flap 446 coupled to the bottom surface of wall 404. Flap 446 is movable relative to wall 404 between a first configuration in which flap 446 covers hole 442, as shown in FIG. 11, and a second configuration in which flap 446 does not cover hole 442, as shown in FIG. 12.

Figure 13:
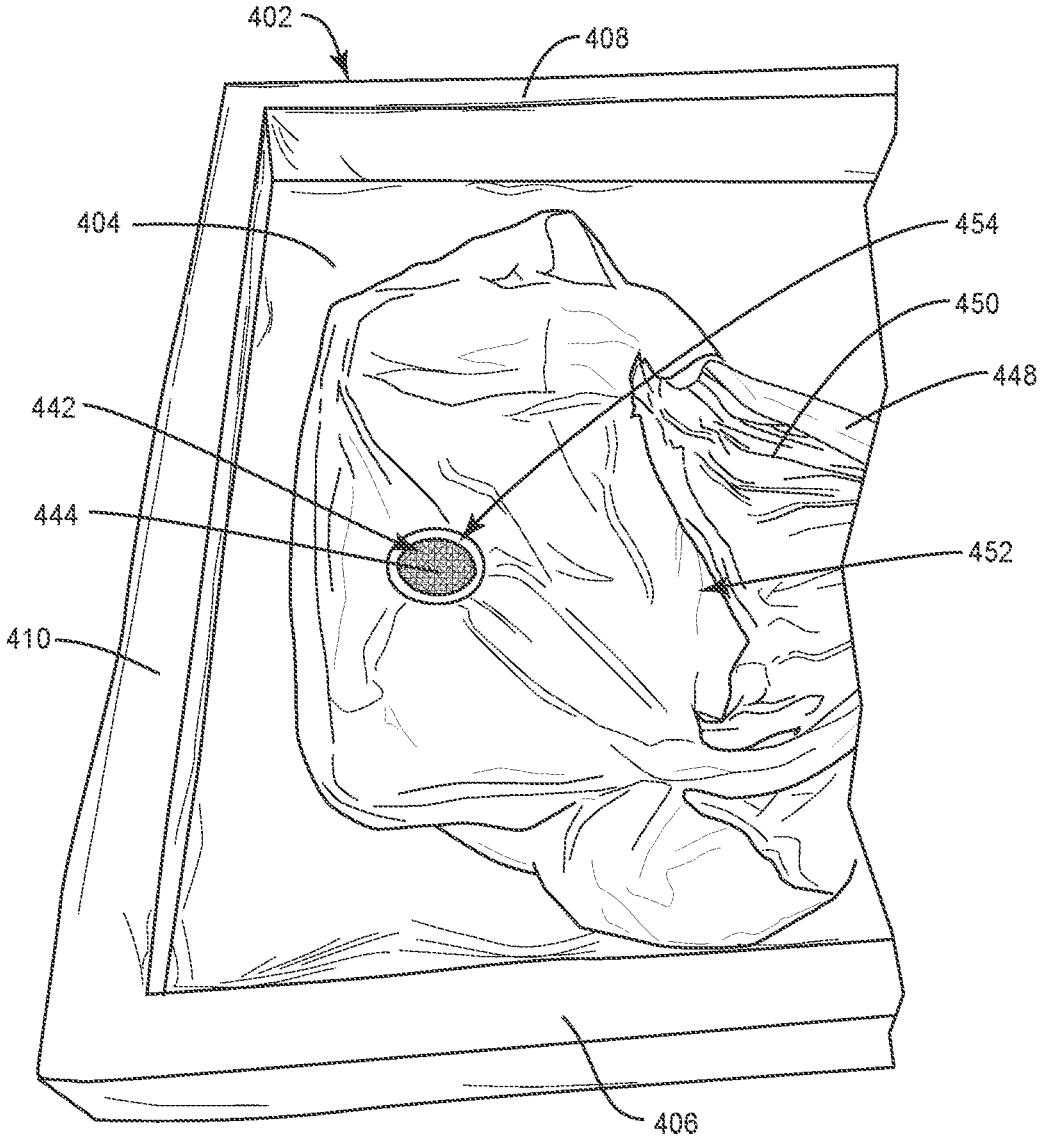
FIG. 13 is a perspective view of components of the bedding system shown in FIG. 2.
Figure 14:
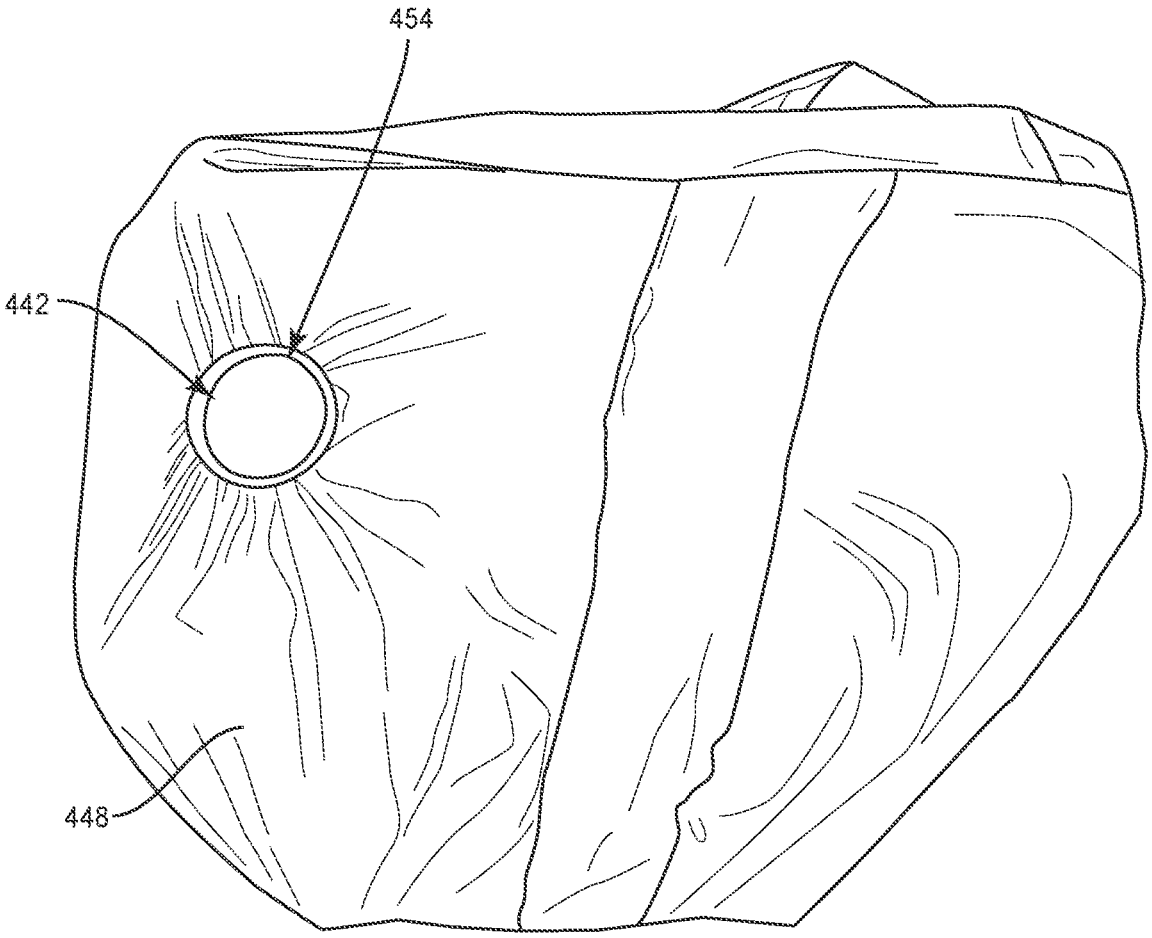
FIG. 14 is a perspective view of components of the bedding system shown in FIG. 2.
Figure 15:
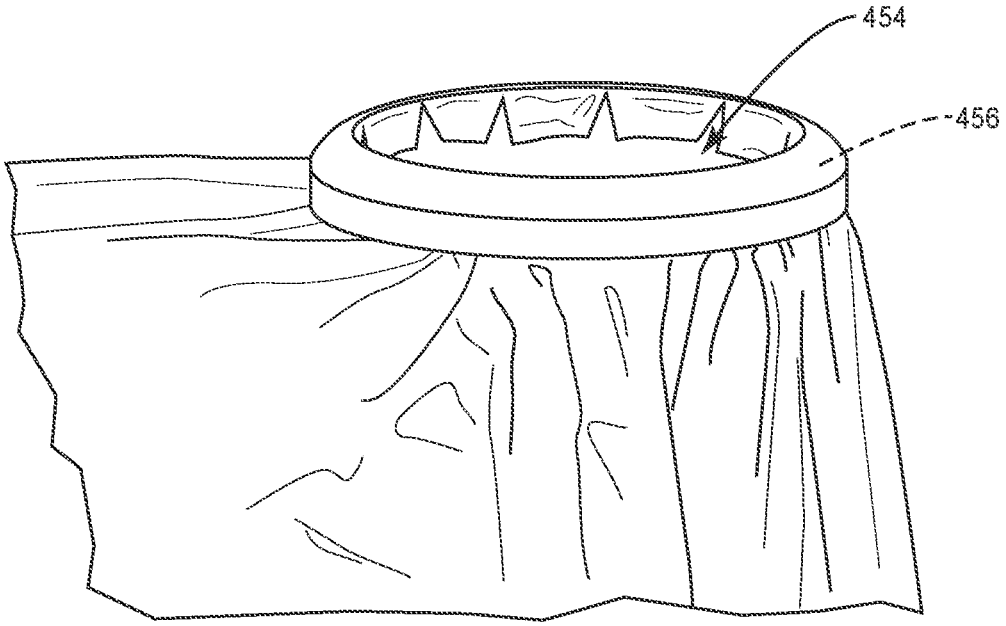
FIG. 15 is a perspective view of components of the bedding system shown in FIG. 2.
Figure 16:
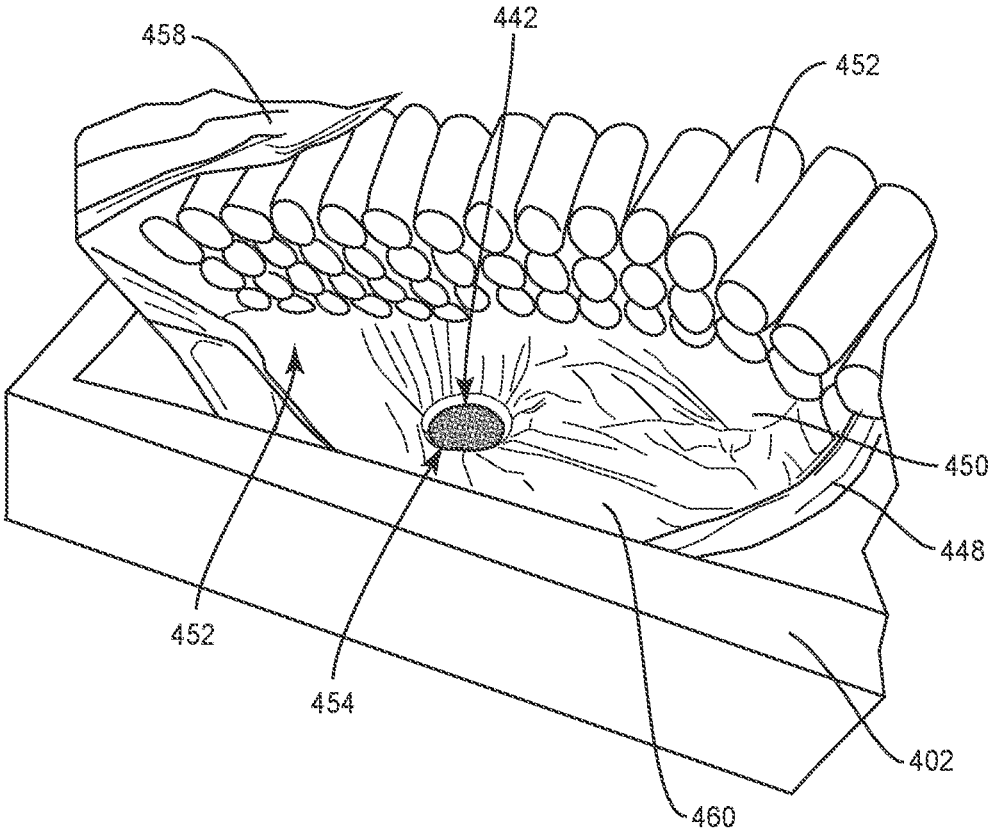
FIG. 16 is a perspective view of components of the bedding system shown in FIG. 2.

A bag, such as, for example, an encasement 448 is positioned in cavity 414, as shown in FIGS. 13-16. Encasement 448 includes an inner surface 450 defining a cavity 452. Encasement 448 further includes an aperture 454 that is in communication with cavity 452. Encasement 448 is coupled to wall 404 such that aperture 454 is aligned with hole 442. In some embodiments, aperture 454 is coaxial with hole 442, as shown in FIGS. 13 and 14, for example. In some embodiments, encasement 448 comprises a rigid collar 456 that defines aperture 454, as shown in FIG. 15, for example. Collar 456 is directly coupled to wall 404. In some embodiments, chassis 402 includes a collar that is coupled to wall 404 and configured to engage collar 456 to couple encasement 448 to wall 404. Encasement 448 comprises a top end 458 and an opposite bottom end 460, aperture 454 extending through end 460, as shown in FIG. 16.

In some embodiments, encasement 448 comprises a wall that extends continuously from end 458 to end 460, wherein the wall includes surface 450. In some embodiments, the wall of encasement 448 comprises a first material and ends 458, 460 each comprise a second material that is different than the first material. In some embodiments, the first material is a non-breathable material and the second material is a breathable material. In some embodiments, the first material forms a seal that extends from end 458 to end 460. In some embodiments, the wall of encasement 448 and end 460 each comprise a first material and end 458 comprises a second material that is different than the first material wherein the first material is a non-breathable material and the second material is a breathable material.

In some embodiments, end 458 and/or end 460 comprises a breathable material. In some embodiments, ends 458, 460 each comprise a breathable material, wherein the material that forms end 458 is more breathable than the material that forms end 460. In some embodiments, ends 458, 460 each comprise a breathable material, wherein the material that forms end 460 is more breathable than the material that forms end 458. In some embodiments, end 458 comprises a breathable material and end 460 comprises a non-breathable material. In some embodiments, end 458 comprises a non-breathable material and end 460 comprises a breathable material.

In some embodiments, the breathable materials discussed herein allow air and/or moisture to move through the material. In some embodiments, the breathable materials discussed herein have pores wherein the pores each have a diameter that is 10 microns or greater. In some embodiments, the breathable materials discussed herein have pores wherein the pores each have a diameter that is 15 microns or greater. In some embodiments, the breathable materials discussed herein have pores wherein the pores each have a diameter that is 20 microns or greater. In some embodiments, the breathable materials discussed herein have pores wherein the pores each have a diameter that is 25 microns or greater. In some embodiments, the breathable materials discussed herein have pores wherein the pores each have a diameter that is 30 microns or greater. In some embodiments, the breathable materials discussed herein have pores wherein the pores each have a diameter that is 35 microns or greater. In some embodiments, the breathable materials discussed herein have pores wherein the pores each have a diameter that is 40 microns or greater. In some embodiments, the breathable materials discussed herein have pores wherein the pores each have a diameter that is 45 microns or greater. In some embodiments, the breathable materials discussed herein have pores wherein the pores each have a diameter that is 50 microns or greater.

In some embodiments, the non-breathable materials discussed herein prevent air and/or moisture from moving through the material. In some embodiments, the non-breathable materials discussed form a barrier that completely prevents air and/or moisture from moving through the material. In some embodiments, the non-breathable materials discussed herein are free of any pores or openings. In some embodiments, the non-breathable materials discussed herein have pores or openings that are each covered with a material, such as, for example, a laminate to prevent air and/or moisture from moving through the pores or openings. In some embodiments, the non-breathable materials discussed herein have pores wherein the pores each have a diameter that is 10 microns or less. In some embodiments, the non-breathable materials discussed herein have pores wherein the pores each have a diameter that is 9 microns or less. In some embodiments, the non-breathable materials discussed herein have pores wherein the pores each have a diameter that is 8 microns or less. In some embodiments, the non-breathable materials discussed herein have pores wherein the pores each have a diameter that is 7 microns or less. In some embodiments, the non-breathable materials discussed herein have pores wherein the pores each have a diameter that is 6 microns or less. In some embodiments, the non-breathable materials discussed herein have pores wherein the pores each have a diameter that is 5 microns or less. In some embodiments, the non-breathable materials discussed herein have pores wherein the pores each have a diameter that is 4 microns or less. In some embodiments, the non-breathable materials discussed herein have pores wherein the pores each have a diameter that is 3 microns or less. In some embodiments, the non-breathable materials discussed herein have pores wherein the pores each have a diameter that is 2 microns or less. In some embodiments, the non-breathable materials discussed herein have pores wherein the pores each have a diameter that is 1 micron or less. In some embodiments, the non-breathable materials discussed herein have pores wherein the pores each have a diameter that is 0.5 microns or less.

A coil pack, such as, for example, coil pack 426 is positioned within cavity 452. In some embodiments, a comfort layer, such as, for example, comfort layer 434 is positioned within cavity 452 on top of coil pack 426 and a cover, such as, for example, cover 438 is positioned over encasement 448 and is coupled to chassis 402 to fix cover 438 relative to chassis 402. In some embodiments, a comfort layer, such as, for example, comfort layer 434 is positioned on top of encasement 448 and a cover, such as, for example, cover 438 is positioned over comfort layer 434 and is coupled to chassis 402 to fix cover 438 relative to chassis 402. In some embodiments, encasement 448 includes a non-breathable material that extends from end 458 to end 460. That is, while ends 458, 460 are made of a breathable material that allow air to move through ends 458, 460, the portion of encasement 448 between end 458 and end 460 is not made of a breathable material in order to direct air flow within encasement 448 through either end 458 and/or end 460. Indeed, because the portion of encasement 448 between end 458 and end 460 is not made of a breathable material, air within encasement 448 will not exit encasement 448 through the portion of encasement 448 between end 458 and end 460. In some embodiments, encasement 448 includes a material that extends from end 458 to end 460 and prevents the movement of air therethrough. In some embodiments, encasement 448 includes a material that extends from end 458 to end 460 and completely prevents the movement of air therethrough such that any air within encasement 448 must exit encasement through end 458 and/or end 460. In some embodiments, encasement 448 is laminated or otherwise sealed between end 458 an end 460 to completely prevent the movement of air therethrough between end 458 an end 460.

In one embodiment, fan 206 or fan 208 is movably from an off position to an on position in which fan 206 or fan 208 creates negative pressure to draw air above surface 436 through cover 438, encasement 448, comfort layer 434 and coil pack 426 and into fans fan 206 or fan 208 to alter the temperature of surface 436 and/or air directly above surface 436. For example, drawing warm air away from surface 436 can cause the warm air to be replaced with cooler air to thereby cool surface 436 and/or air directly above surface 436. In another embodiment, fan 206 or fan 208 is movable from an off position to an on position in which fan 206 or fan 208 creates positive pressure to move air from fan 206 or fan 208 through encasement 448, coil pack 426, comfort layer 434 and cover 438 to alter the temperature of surface 436 and/or air directly above surface 436. For example, moving cool air from fan 206 or fan 208 through surface 436 can reduce the temperature of surface 436 and/or air directly above surface 436 to thereby cool surface 436 and/or air directly above surface 436.

In some embodiments, platform 216 includes a fastener, such as, for example, a cleat or clamp 225 coupled to a top surface of platform 216, as best shown in FIG. 9. Clamp 225 comprises a bracket 227 that is coupled directly to the top surface of platform 216 and an arm 229 that is rotatable relative to bracket 227. In particular, arm 229 is rotatable relative to bracket 227 between a first configuration in which arm 229 is spaced apart from chassis 402 and a second configuration in which arm 229 directly engages chassis 402 to prevent chassis 402 from sliding relative to base 200. It is envisioned that system 100 may include one or a plurality of clamps 225.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bedding system comprising: a base;

an air control unit coupled to positioned underneath the base;

a duct connecting the air control unit to the base;

a bag positioned above the base, the bag comprising opposite top and bottom ends, the bag comprising coils positioned therein, the top end being made from a material, the top end being free of any openings that extend through the material that are not inherent in the material;

an air passage formed between the duct at the base and the bottom end of the bag:

a comfort layer positioned above the bag such that the comfort layer operatively engages the top end of the bag; and a cover positioned on the comfort layer, wherein the duct is spaced apart from the bag by the base.

2. The bedding system recited in claim 1, wherein the air control unit comprises a left fan and a right fan.

3. The bedding system recited in claim 1, wherein the air control unit comprises a left fan and a right fan, and the duct comprises a first duct being connected to the left fan and a second duct being connected to the right fan.

4. The bedding system recited in claim 3, wherein the base is adjustable and the air passage comprises a first air passage and a second air passage, the first air passage being operatively connected to the left fan, the second air passage being operatively connected to the right fan.

5. The bedding system recited in claim 4, wherein the material is breathable.

6. The bedding system recited in claim 1, wherein the bag is sealed except at the bottom end for the air passage.

7. The bedding system recited in claim 1, wherein the comfort layer is breathable.

8. The bedding system recited in claim 1, further comprising a clamp coupled to the base, the bag being positioned within a chassis of the bedding system, the clamp being rotatable relative to the base and configured to fix the chassis to the base.

9. A bedding system comprising:

an adjustable base having a top surface;

an air control unit operatively coupled to the base, the air control unit comprising a left fan and a right fan, the fans being positioned under the base, each fan having a respective air outlet;

a first air passage to defined from the air outlet of the left fan and through the adjustable base to the top surface;

a second air passage defined from the air outlet of the right fan and through the adjustable base to the top surface;

a base layer that overlies the top surface of the adjustable base, said base layer defining a cavity therein that is in communication with at least one of the first and second air passages;

a sealed bag positioned in the cavity, the bag comprising coils positioned therein, and the bag comprising opposite top and bottom ends, the top end being made from a material, the top end being free of any openings that extend through the material that are not inherent in the material, the material being breathable and the bottom end having at least one opening that is in communication with at least one of the first and second air passages;

a duct that is spaced apart from the bag by the base;

a breathable comfort layer above the bag such that the comfort layer operatively engages the top end; and a cover positioned on the comfort layer.

10. The bedding system recited in claim 9, wherein the coils define air channels therethrough.

11. A bedding system comprising:

a base comprising a hinged frame having an opening therethrough;

a mattress positioned on top of the base, the mattress comprising:

a chassis comprising a bottom wall, opposite first and second side walls extending upwardly from the bottom wall and opposite first and second end walls extending upwardly from the bottom wall, the walls defining a cavity, the bottom wall defining an opening that is in communication with the cavity, a bag positioned in the cavity, the bag comprising opposite top and bottom ends, the top end being made from a material, the top end being free of any openings that extend through the material that are not inherent in the material;

a coil pack positioned in the bag, the coil pack comprising a plurality of springs, a comfort layer positioned above the bag such that the comfort layer operatively engages the top end, and a cover positioned over the comfort layer; and an air control assembly comprising a power unit and a duct having a first end that is connected to the power unit and a second end that connects to the base opening and is positioned adjacent outside the chassis opening such that the duct is spaced apart from the mattress by the base.

12. The bedding system recited in claim 11, wherein the power unit is configured to create negative pressure that moves air adjacent to the cover through the cover and the comfort layer and into the bag.

13. The bedding system recited in claim 11, wherein the power unit is configured to create negative pressure that moves air within the bag into the air control assembly unit.

14. The bedding system recited in claim 11, wherein the power unit is configured to create positive pressure that moves air in the bag through the comfort layer and the cover.

15. The bedding system recited in claim 11, wherein the base comprises a tilting assembly coupled to the frame, the tilting assembly comprising opposite first and second ends and a hinge between the first end and the second end configured to allow the first end to pivot relative to the second end.

16. The bedding system recited in claim 15, wherein the mattress comprises a head end and an opposite foot end, the mattress being positioned on top of the tilting assembly such that the foot end pivots relative to the head end as the first end of the tilting assembly pivots relative to the second end of the tilting assembly.

17. The bedding system recited in claim 11, wherein the power unit is coupled directly to the frame.

* * * * *